US005552067A

United States Patent [19]

Placek

[11] Patent Number: 5,552,067

[45] Date of Patent: Sep. 3, 1996

[54] THERMALLY STABILIZING ORGANIC FUNCTIONAL FLUIDS IN THE ABSENCE OF OXYGENS

[75] Inventor: Douglas G. Placek, Fairless Hills, Pa.

[73] Assignee: FMC Corporation, Philadelphia, Pa.

[21] Appl. No.: 231,220

[22] Filed: Apr. 22, 1994

[51] Int. Cl.[6] ..... C10M 127/00

[52] U.S. Cl. ..... 508/433; 508/436; 508/440

[58] Field of Search ..... 252/32.5, 51.5 A, 252/52 R, 56 R

[56] References Cited

U.S. PATENT DOCUMENTS

| | | | |
|---|---|---|---|
| 2,193,613 | 3/1940 | Alexander | 260/36 |
| 2,272,996 | 2/1942 | Warner et al. | 260/36 |
| 2,377,630 | 6/1945 | Hyde | 252/63.2 |
| 3,004,080 | 10/1961 | Closson et al. | 260/666 |
| 3,219,620 | 11/1965 | Fear | 260/33.6 |
| 3,406,144 | 10/1968 | Marshall | 260/45.8 |
| 3,608,385 | 9/1971 | Duling et al. | 74/200 |
| 3,661,780 | 5/1972 | Feighner et al. | 252/59 |
| 3,671,488 | 6/1972 | Stuetz | 260/45.7 R |
| 4,225,747 | 9/1980 | Vecellio | 174/25 C |
| 4,444,938 | 4/1984 | Coggins et al. | 524/476 |
| 4,458,047 | 7/1984 | Vanderwerff | 524/476 |
| 4,521,324 | 6/1985 | Tsubouchi et al. | 252/73 |
| 4,604,493 | 8/1986 | Shimizu et al. | 585/360 |
| 4,684,754 | 8/1987 | Tsubouchi et al. | 585/21 |
| 4,755,317 | 7/1988 | Minokami et al. | 252/73 |
| 4,800,032 | 1/1989 | Murphy | 252/51.5 R |
| 4,874,783 | 10/1989 | Nelson et al. | 524/482 |

OTHER PUBLICATIONS

Blake et al., "Thermal Stability as a Function of Chemical Structure," *J. Chem. Eng. Data*, 6:1, Jan. 1961, pp. 87–98.

Kirk–Othmer, *Encyclopedia of Chemical Technology*, vol. 12, pp. 712–733.

*Primary Examiner*—Jacqueline V. Howard

*Attorney, Agent, or Firm*—Richard E. Elden; Patrick C. Baker; Robert L. Andersen

[57] ABSTRACT

A method and compositions are presented to provide a functional fluid with an increased thermal stability in the absence of oxygen, the functional fluid base comprising from about 5% to 100% by weight of a triester of a phosphorus acid and from 0% to 95% by weight of a fluid selected from the group consisting of C10–C20 paraffin hydrocarbons, C10–C°aromatic hydrocarbons, C8–C15 dialkyl ethers, C8–C15 N,N dialkyl amides, esters of mono- and di-carboxylic acids, and mixtures thereof, the improvement comprising incorporating into the fluid a compound selected from the group consisting of tetrahydronaphthalene and decahydronaphthalene in sufficient quantity to provide an increased stability to high temperature in the absence of oxygen.

8 Claims, 3 Drawing Sheets

THERMALLY STABILIZING ORGANIC FUNCTIONAL FLUIDS IN THE ABSENCE OF OXYGENS

The present invention provides both a method to improve the thermal stability of organic compounds in the absence of oxygen when employed as a functional fluid base as well as their compositions.

Stabilizer additives are commercially available that protect hydrocarbons and oxygenated hydrocarbons (esters, ethers, ketones, phosphate esters, etc.) against oxidation. Compounds that typically require stabilization include: functional fluids (hydraulic fluids, heat transfer fluids, solvents), lubricants, polymers, and resins. Anti-oxidants typically function by interrupting the oxidation chain reaction by capturing free radicals and protecting against rapid degradation.

Many compounds also decompose in the absence of oxygen owing to thermal stress at high temperatures. Oxidation typically precedes thermal decomposition, therefore many high temperature applications utilize fluids in an oxygen-free environment blanketed with an inert gas. Thermal decomposition may be the primary cause for fluid failures in applications where oxygen is not present. At present there are no chemical compounds known to inhibit thermal degradation.

Blake et al., "Thermal Stability as a Function of Chemical Structure," J. Chem. Eng. Data, Vol. 6, No. 1, page 87 (1961) discloses that increasing emphasis is being placed on thermal stability of functional fluids, such as lubricants, heat exchange fluids and hydraulic fluids. For lubricants and hydraulic fluids other properties such as viscosity, pour point, oxidative stability, and vapor pressure are important, such properties are amenable to improvement by additives and minor structural modifications. Until the work of Blake et al. there was no systematic recording in the chemical literature of the thermal stability of organic compounds. This work found that the strength of the weakest C—C bond in an organic compound determined the upper temperature at which a compound could be exposed without decomposition. Resonance increases the bond stability but the availability of a low energy decomposition intermediate mechanism lowers the bond stability.

Decomposition is generally indicated by an increase of color, an increase of acidity, by a change of viscosity and by the appearance of deposits.

The most stable aliphatic compounds—with the possible exception of the cycloaliphatics—were normal paraffins. A few groups such as silane, silicate, or borate can be introduced into a paraffin chain without reducing thermal stability. Most structural modifications of normal paraffins, however, such as branching or introducing groups such as ether, ester, amide, or phosphate, lower the stability either by introducing more favorable sites for free radical attack or by opening paths for low-energy decomposition mechanisms. For compounds such as esters, which can decompose intramolecularly, free radical chain decomposition may to some degree occur simultaneously. The higher the activation energy of the intramolecular transition state, the greater will be the participation of the chain mechanism in decomposition.

The invention is a heat-stable functional fluid comprising as a base at least 5% by weight of a triester of a phosphorus acid, and from 0% to 95% by weight of a fluid C10–C20 paraffin hydrocarbons, C10–C20 aromatic hydrocarbons, C8–C15 dialkyl ethers, C8–C15 N, N dialkyl amides, esters of mono- and di-carboxylic acids, and mixtures thereof to which is added sufficient quantities of either tetrahydronaphthalene or decahydronaphthalene to provide increased stability to the functional fluid at high temperatures in the absence of oxygen.

One embodiment of the present invention is a heat-stable functional fluid base comprising from about 5% to 100% by weight of a triester of a phosphorus acid and from 0% to 95% by weight of a fluid selected from the group consisting of C10–C20 paraffin hydrocarbons, C10–C20 aromatic hydrocarbons, C8–C15 dialkyl ethers, C8–C15 N,N dialkyl amides, esters of mono- and di-carboxylic acids, and mixtures thereof, the base fluid containing, in addition, a compound selected from the group consisting of tetrahydronaphthalene and decahydronaphthalene in sufficient quantity to provide an increased stability to high temperature in the absence of oxygen.

In another embodiment the invention is a method for improving the heat-stability of a functional fluid comprising a base fluid selected from the group consisting of C10–C20 paraffin hydrocarbons, C10–C20 aromatic hydrocarbons, C8–C15 dialkyl ethers, C8–C15 N,N dialkyl amides, esters of mono- and di-carboxylic acids, triesters of phosphorus acids, and mixtures thereof, the improvement comprising incorporating into the base fluid a compound selected from the group consisting of tetrahydronaphthalene and decahydronaphthalene in sufficient quantity to provide an increased stability to high temperature in the absence of oxygen.

Surprisingly, it was found that while 1% or less tetrahydronaphthalene and decahydronaphthalene are effective in improving the high temperature stability of organic compounds in the absence of oxygen, the compounds are essentially ineffective in the presence of oxygen. Organic fluids exposed to high temperature in the absence of oxygen are employed as heat transfer fluids, lubricants, and hydraulic fluids, and are collectively called "functional fluids" for the purpose of this invention.

Heat transfer fluids commonly contain as a base fluid diphenyl, diphenyl oxide and mixtures thereof as well as petroleum base fluids. Lubricants and hydraulic fluids are subject to high temperature and contain as base fluids C10–C20 straight chain paraffins, C10–C20 aromatics (naphthalene-based lubricants), esters of carboxylic acids, esters of phosphorus acids and amides. All of these base fluids are employed with additives such as anti-oxidants to minimize decomposition initiated by inadvertent exposure to oxygen as well as other additives.

Both lubricants and hydraulic fluids usually are formulated as a base fluid together with other compounds as additives, such as anti-oxidants, pour point additives, viscosity modifiers, anti-wear additives, corrosion inhibitors, foam inhibitors and the like. Such additives are generally incorporated as proprietary formulations in small amounts. A grease is a lubricant thickened with a soap or the like to increase its viscosity.

Hydrocarbons are well known to be useful as base fluids for lubricants, hydraulic fluids and heat exchange fluids. Straight chain paraffinic hydrocarbons are well known to be highly thermal stable while branched chain paraffins are known to be less stable, presumably because of steric crowding at the branched carbon. On the other hand, aromatic (naphthalenic) hydrocarbons have greater thermal stability because of resonance stabilization.

Carboxylic esters are an important class of synthetic lubricants. Bis(2-ethylhexyl)sebacate is widely used as a base fluid for military lubricants and carboxylic acid esters of monohydric alcohols having no β hydrogen have even greater thermal stability (2,2-dialkylcarboxylic esters), as well as benzyl alcohol-type esters where the β hydrogen is stabilized by the benzene ring. Other suitable carboxylic acid esters are neopentyl polyol esters of sebacic acid, phthalic acid and the like.

Ethers are used in heat transfer base fluids and also in lubricant and hydraulic base fluids. Ethers, such as diphenyloxide are particularly useful as heat transfer fluids for use at high temperatures.

Organic triesters of phosphorus acids are also employed in lubricants and hydraulic fluids. Typical esters include triarylphosphates, trialkyl phosphates, neutral alkylaryl phosphates, alkoxyalkyl phosphates, triaryl phosphite, trialkylphosphite, neutral alkyl aryl phosphites, neutral phosphonate esters and neutral phosphine oxide esters. Neutral acids of phosphorus acids are the triesters rather than an acid (HO-P) or a salt of an acid.

Dimers and derivatives of tetrahydronaphthaline and decahydronaphthalene are known to be useful in some special formulations. U.S. Pat. No. 4,225,747 teaches a lower aliphatic derivative of naphthalene as well as tetrahydronaphthalene is a useful dielectric for oil-filled submarine electric power cables.

U.S. Pat. No. 3,004,080 teaches that certain alkyl-substituted tetrahydronaphthalenes react with oxygen to form hydroperoxides useful for the preparation of monomers, polymers and the like.

U.S. Pat. Nos. 3,608,385; 4,684,754; 4,755,317 and 4,521,324 disclose that C13–C40 substituted decahydronaphthalenes are useful lubricant additives in combination with perhydrogenated polymers of styrenes, and the likes in a hydrocarbon base fluid for power transmission systems. While derivatives of decahydronaphthalene and tetrahydronaphthalene are disclosed to be useful as plasticizers in PTB polymers (U.S. Pat. Nos. 4,458,047 and 4,444,938), none of these patents suggests or discloses the use of decahydronaphthalene, tetrahydronaphthalene or derivatives thereof to improve the high temperature stability of functional fluids in the absence of oxygen.

Phosphate esters are commercially used as fire resistant hydraulic fluids, lubricant additives, and flame retardant plasticizers. The operating environments of some severe applications require that the phosphate ester endure high temperatures that can cause thermal degradation.

Triaryl, trialkyl, and aryl/alkyl phosphates show signs of thermal decomposition in an inert nitrogen environment if subjected to temperatures above 250° C. for more than 2 hours. Phosphate ester compounds have been stabilized to function for extended periods of time in severe environments. Phosphate ester functional fluids exposed to 340° C. for 5 hours decompose as indicated by increases in viscosity, polymerized deposits, and increased acidity. A triaryl phosphate ester containing 0.5% to 5.0% of decahydronaphthalene DHN or tetrahydronaphthalene THN survived 340° C. for 5 hours with no change in viscosity, acidity, color, odor, and no deposits were formed.

Any C4 to C8 alkyl phosphate ester may be employed in the invention. For example, tributyl phosphate (TBP) and tri isooctal phosphate (TOF). The specific triphosphate ester or combination of esters can easily be selected by one skilled in the art to adjust the density, viscosity etc. of the formulated fluid. Mixed esters, such as dibutyl octyl phosphate or the like may be employed rather than a mixture of two or more trialkyl phosphates.

A trialkyl phosphate is often useful to adjust the specific gravity of the formulation, but it is desirable that the specific trialkyl phosphate be a liquid at low temperatures. Consequently, a mixed ester containing at least one partially alkylated with a C3 to C4 alkyl group is very desirable, for example, 4-isopropylphenyl diphenyl phosphate or 3-butylphenyl diphenyl phosphate. Even more desirable is a triaryl phosphate produced by partially alkylating phenol with butylene or propylene to form a mixed phenol which is then reacted with phosphorus oxychloride as taught in U.S. Pat. No. 3,576,923.

Any mixed triaryl phosphate (TAP) esters may be used as cresyl diphenyl phosphate, tricresyl phosphate, mixed xylyl cresyl phosphates, lower alkylphenyl/phenyl phosphates, such as mixed isopropylphenyl/phenyl phosphates, t-butylphenyl phenyl phosphates. These esters are used extensively as plasticizers, functional fluids, gasoline additives, flame-retardant additives and the like.

It will be understood that other additives such as corrosion inhibitors, oxidation inhibitors, anti-wear agents, detergents, stabilizers, metal deactivators, foam inhibitors, and the like, such as epoxides, dialkyl sulfides, benzotriazole, phenyl alpha-naphthalamine and phenolic oxidation inhibitors, well known as functional fluid additives in the art, can also be incorporated in the functional fluid composition of the invention, in relatively small amounts, if desired.

Commonly used additives according to Kirk-Othmer include pour-point depressants such as alkylaromatic polymers and polymethacrylates, viscosity index improvers (VI improvers), high molecular weight polymers that increase the relative viscosity of an oil at high temperatures more than they do at low temperatures. The most common VI improvers are methacrylate polymers and copolymers, acrylate polymers, olefin polymers (qv) and copolymers, and styrene-butadiene copolymers.

Other additives are defoamers, such as silicone polymers, the most widely used defoamers. Organic polymers are sometimes used as defoamers although much higher concentrations are required.

Oxidation inhibitors, organic compounds containing sulfur, nitrogen, phosphorus and some alkylphenols are also employed. Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methylphenol [2,6-di(tert-butyl)-p-cresol, DBPC], and aromatic amines, e.g. N-phenyl-α-naphthalamine. These are used in turbine, circulation, and hydraulic oils that are intended for extended service.

Corrosion and rust inhibitors, typically amine succinates and alkaline earth sulfonates are employed for corrosion inhibition. Optionally, phosphorus-containing materials, such as acid phosphate esters are employed as rust inhibitors.

Wear and friction reducing compounds commonly employed are long chain molecules which form a film on metal surfaces.

The functional fluid may contain from 0.1% to 10% of tetrahydronaphthalene or decahydronaphthalene added to the base functional fluid. Desirably the content will be about 0.5% to 5%; generally about 1% is sufficient.

The following examples are provided as further illustrations for the invention but not as limitations thereto. The prior art has shown that triesters of phosphorus acids are less stable thermally than paraffins, aromatic and other compounds employed in functional fluids. Therefore, tricresyl phosphate was employed in the Example 1 to more clearly demonstrate the thermal stabilizing effect of tetrahydronaphthalene (THN) and decahydronaphthalene (DHN) using conventional thermogravimetric analysis (TGA) and differential scanning calorimetry (DSC) in an inert atmosphere (nitrogen).

EXAMPLE 1

Figure 1:
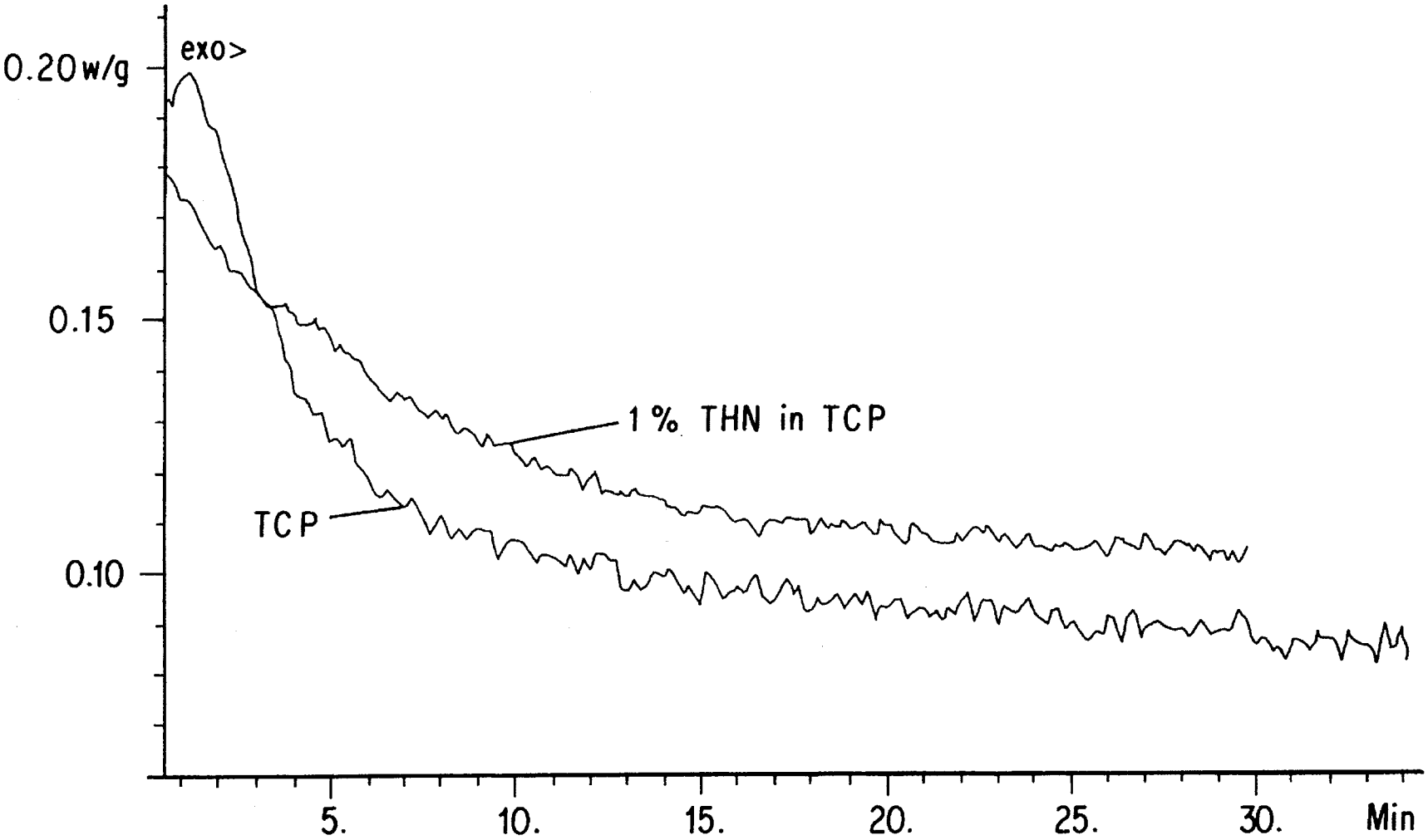
FIG. 1 is an isothermal DSC scan comparing tricresyl phosphate (TCP) with and Without 1% THN.
Figure 2:
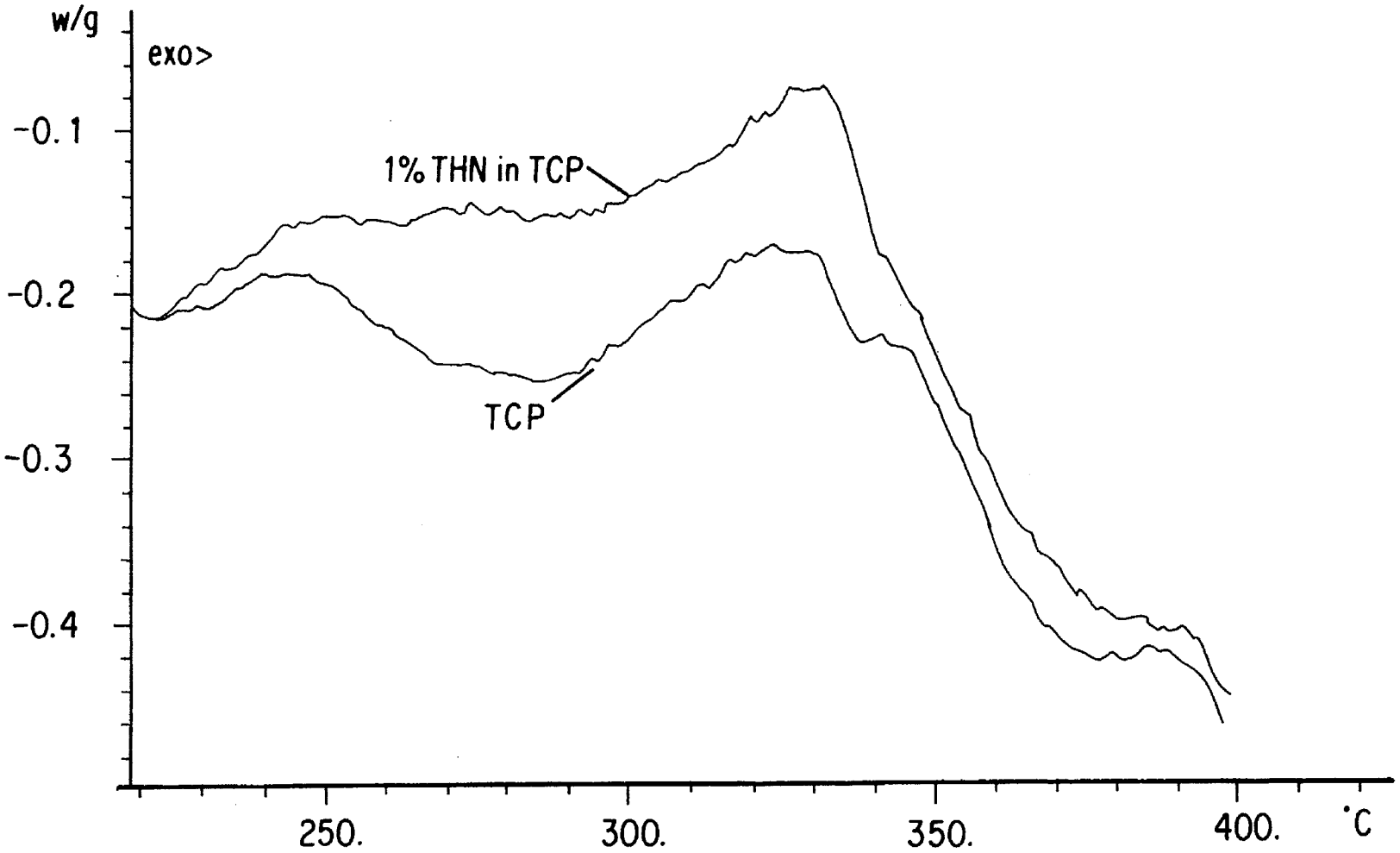
FIG. 2 is a comparative DSC scan of the two above compositions.
Figure 3:
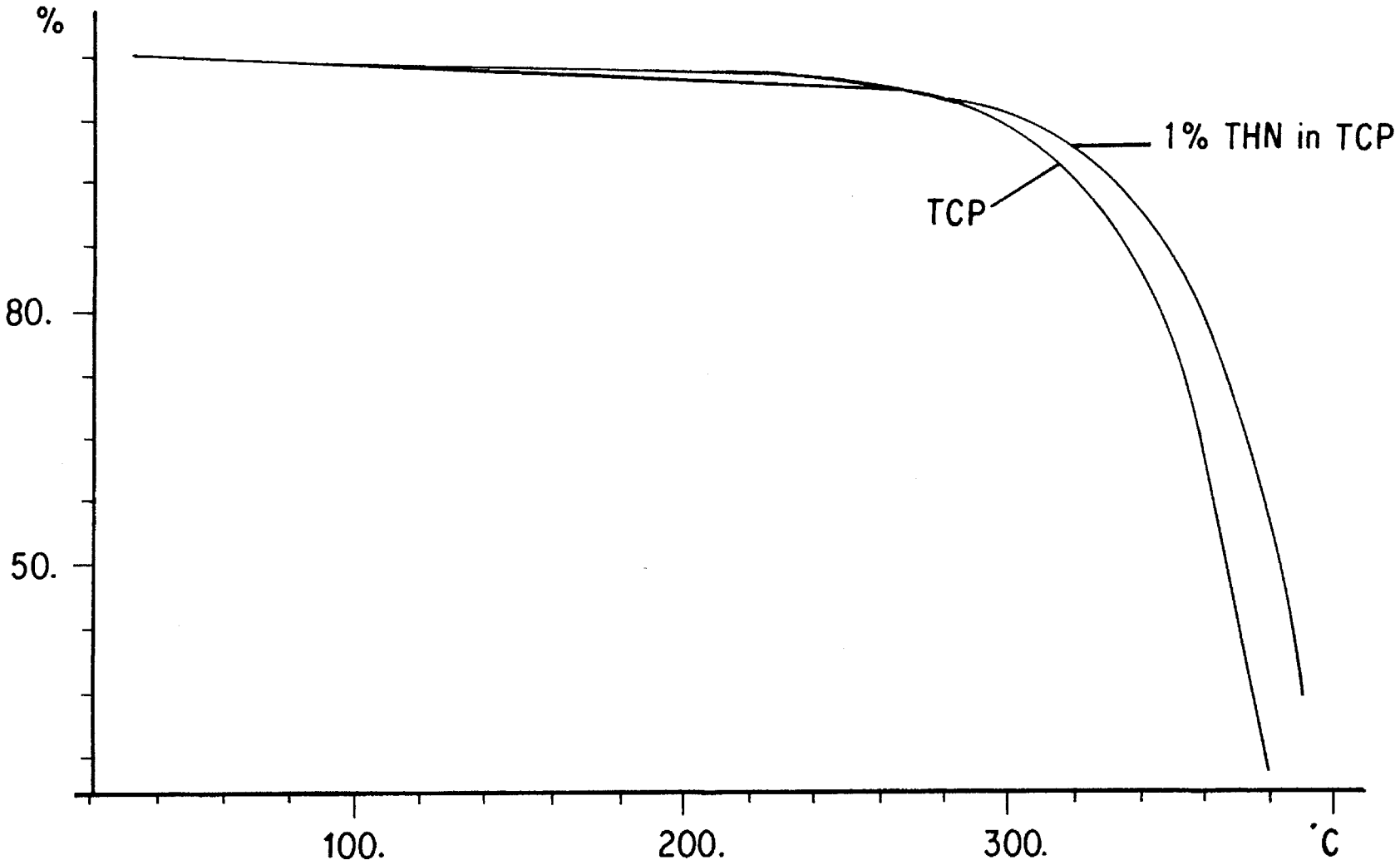
FIG. 3 is a comparative TGA scan of the same two compositions.

Example 1 demonstrates the improved decomposition profile of tricresyl phosphate containing 1% THN. FIG. 1 is an enlarged comparative isothermal DSC scan which highlights the significantly reduced endotherm which indicates less decomposition and a slower rate of reaction. FIG. 2 is a comparative dynamic DSC scan ramped at 10 C/minute. This scan indicates that tricresyl phosphate with 1% THN does not decompose over the 250°–300° C. temperature range, but the straight tricresyl phosphate sample shows an endotherm indicating decomposition. The endotherms shown after 330° C. indicate a combination of evaporation and decomposition. A comparative TGA scan (FIG. 3) indicates that the tricresyl phosphate sample treated with THN shows a slower rate of weight loss than pure TCP. This data also indicates that the THN is hindering thermal decomposition.

EXAMPLE 2

The thermal stability of phosphate esters with and without THN were compared by adding 200 ml of the ester to a 1 liter flask and heating to 340° C. for 5 hours exposed to an atmosphere of either nitrogen or air. The amount of thermal degradation was evaluated by color change, increase in acid number (TAN), by ASTM procedure D974, by change in viscosity, and by the presence of deposits. The results are presented as Table I.

As can be observed, the tests with tricresyl phosphate indicate that the test procedures of Example 2 agree with the thermal analyses of Example 1.

In each run in the absence of oxygen the presence of tetrahydronaphthalene (THN) resulted in significantly less decomposition than in the sample without THN. However, in the presence of air the samples with THN were more degraded.

TABLE I

THERMAL STABILITY TEST AT 5 HOURS AT 340° C.

| Sample | Color Change | TAN increase | Viscosity Change | Deposits |
|---|---|---|---|---|
| IN NITROGEN | | | | |
| Tricresyl Phosphate | Amber | 2.20 | +7% | Light |
| Tricresyl Phosphate + 1% THN | None | 0.3 | +1% | None |
| Isopropylphenyl Phosphate | Amber | 4.3 | +6% | Light |
| Isopropylphenyl Phosphate + 1% THN | None | 0.4 | +1% | None |
| t-Butylphenyl Phosphate | Amber | 5.8 | +10% | Light |
| t-Butylphenyl Phosphate + 1% THN | None | 0.4 | +3% | None |
| IN AIR | | | | |
| t-Butylphenyl Phosphate | Brown | 25 | +20% | Moderate |
| t-Butylphenyl Phosphate + 1% THN | Brown | 30 | +50% | Moderate |

I claim:

1. A method for improving the heat-stability of a functional fluid comprising from about 5% to 100% by weight of a triester of a phosphorus acid and from 0% to 95% by weight of a fluid selected from the group consisting of C10–C20 paraffin hydrocarbons, C10–C20 aromatic hydrocarbons, C8–C15 dialkyl ethers, C8–C15 N,N dialkyl amides, esters of mono- and di-carboxylic acids, and mixtures thereof, the improvement comprising incorporating into the base fluid a compound selected from the group consisting of tetrahydronaphthalene and decahydronaphthalene in sufficient quantity to provide an increased stability to high temperature in the absence of oxygen.

2. The method of claim 1 and wherein containing as additives viscosity modifiers, pour point modifiers, anti-wear additives, detergents, foam inhibitors, corrosion inhibitors.

3. The method of claim 1 wherein the triester of a phosphorus ester is a triaryl phosphate produced by partially alkylating phenol with butylene or propylene which alkylated phenol is subsequently reacted with phosphorus oxychloride.

4. The method of claim 1 wherein the triester of a phosphorus acid is a triaryl phosphate, a trialkyl phosphate, a diaryl monoalkyl phosphate or monoaryl dialkyl phosphate.

5. The method of claim 1 wherein the functional fluid further comprises as additives detergents, foam inhibitors, corrosion inhibitors.

6. The method of claim 5 wherein the triester of a phosphorus acid is a triaryl phosphate, a trialkyl phosphate, a diaryl monoalkyl phosphate or monoaryl dialkyl phosphate.

7. The method of claim 1 wherein the functional fluid is a heat transfer fluid comprising the composition of claim 1 and further comprising as additives viscosity modifiers, pour point modifiers, anti-wear additives, detergents, foam inhibitors, corrosion inhibitors.

8. The heat transfer fluid of claim 7 wherein the triester of a phosphorus acid is a triaryl phosphate, a trialkyl phosphate, a diaryl monoalkyl phosphate or monoaryl dialkyl phosphate.

* * * * *